United States Patent [19]

Rowe

[11] 4,253,313

[45] Mar. 3, 1981

[54] PROCEDURES AND APPARATUS FOR THE CONDITIONING AND PROTECTION OF WORKMEN IN HOT ENVIRONMENTS

[76] Inventor: Alexander W. Rowe, 45 Burn St., Waverley, Johannesburg, 2192, Transvaal, South Africa

[21] Appl. No.: 964,844

[22] Filed: Nov. 29, 1978

[30] Foreign Application Priority Data

Dec. 5, 1977 [ZA] South Africa ..... 77/7253

[51] Int. Cl.[3] ..... F25D 23/12

[52] U.S. Cl. ..... 62/259 B; 62/304

[58] Field of Search ..... 62/259 B, 91, 121, 316, 62/317; 128/402

[56] References Cited

U.S. PATENT DOCUMENTS

| | | | |
|---|---|---|---|
| 2,010,132 | 8/1935 | Bischoff | 62/304 |
| 2,544,381 | 3/1951 | Goldmerstein | 62/304 |
| 3,000,190 | 9/1961 | Stark | 62/259 B |
| 3,070,803 | 1/1963 | Slepicka | 62/259 B |
| 3,074,250 | 1/1963 | Everett | 62/259 B |
| 3,125,865 | 3/1964 | Bemelman | 62/259 B |
| 3,212,286 | 10/1965 | Curtis | 62/304 X |
| 3,296,819 | 1/1967 | Gough | 62/259 B |
| 3,429,138 | 2/1969 | Goldmerstein | 62/259 B |
| 3,452,554 | 7/1969 | Smith | 62/259 B |
| 3,610,323 | 10/1971 | Troyer | 62/259 B |
| 3,802,215 | 4/1974 | Rowe | 62/259 B |

FOREIGN PATENT DOCUMENTS

| | | |
|---|---|---|
| 455283 | 10/1936 | United Kingdom . |
| 500270 | 4/1937 | United Kingdom . |
| 497710 | 12/1938 | United Kingdom . |
| 1170702 | 11/1969 | United Kingdom . |
| 1236290 | 6/1971 | United Kingdom . |
| 1458357 | 12/1976 | United Kingdom . |

*Primary Examiner*—Lloyd L. King

*Attorney, Agent, or Firm*—Ladas & Parry

[57] ABSTRACT

Apparatus for cooling a workman in thermally stressful conditions comprises a pocket for containing ice that cools the workman by conduction. When the ice melts, the water is led on to the skin of the workman where it cools him further when the water evaporates.

10 Claims, 3 Drawing Figures

FIG. 1
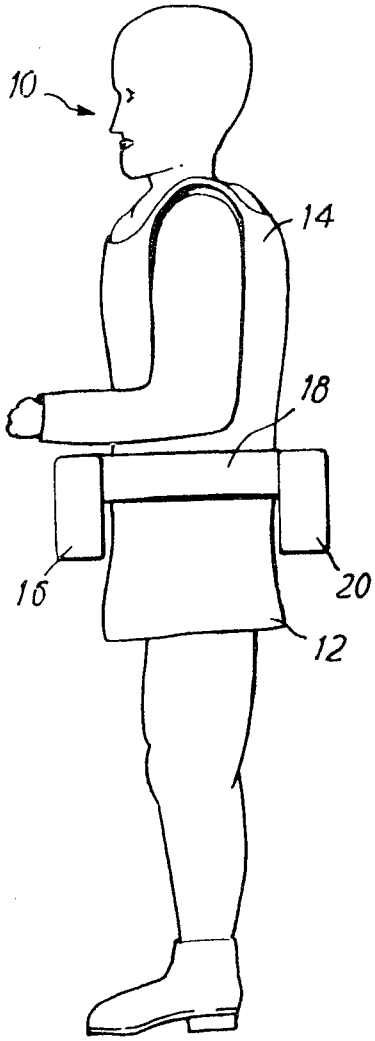
FIG. 2
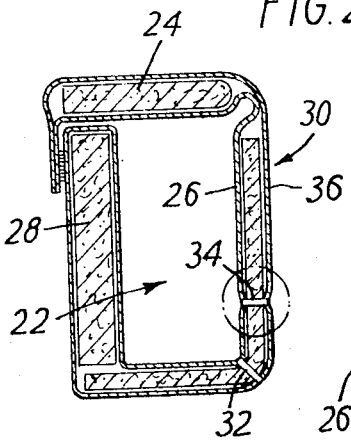
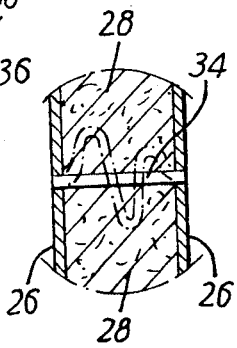
FIG. 2a
FIG. 3
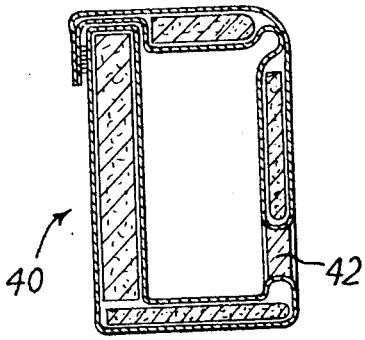

PROCEDURES AND APPARATUS FOR THE CONDITIONING AND PROTECTION OF WORKMEN IN HOT ENVIRONMENTS

This invention relates to methods and apparatus for the conditioning and protection of workmen in hot environments, such as for example in the stopes and other working areas of hot humid mines.

There have been many suggestions for the cooling of workmen in hot environments. In addition there have been advances relating to the pretreatment or the acclimatisation of such workmen in order to minimise or avoid heat stroke. A number of advances particularly relating to the use of sublimitation solids, have been described in our South African Pat. No. 71/6699 and U.S. Pat. No. 3,802,215. In a known apparatus, subliming solids, such as solid carbon dioxide has been used at pressures from approximately 35KPa to 140KPa. Two phases of state of these subliming solids are used to effect cooling, i.e. solid and gas. In other words the cooling medium passes through a single phase transformation. Other methods of cooling also employ single phase transformation e.g. from a solid to a liquid or from a liquid to a gas or directly from a solid to a gas.

According to one aspect of the invention there is provided a method of cooling a workman working under thermally stressful conditions comprising maintaining a solid meltable coolant in heat transfer relationship with the workman and cooling the workman by transfer of heat to the coolant with the result that the coolant melts, characterised in that the melted coolant is lead into a position (herinafter called "the evaporation position") in heat transfer relationship with the workman and there is evaporated. Thus the workman will be cooled by the heat transfer during phase change from solid to liquid, during the heating of the liquid coolant and then during phase change during evaporation. The evaporation position is preferably in contact with the skin of the workman and preferably there is provided an article of clothing in contact with the skin of the workman on to which the melted coolant is conveyed.

The coolant can be any material which has a high enthalpy at phase change. Preferably the coolant is water which not only has the attributes thus mentioned but also is non-toxic and readily available.

The liquid coolant is preferably heated before being conveyed to the evaporation position so that excessively cold liquid is not brought into contact with the skin of the workman. This may be effected by conveying the liquid coolant to the evaporation position, through a long path. Further, or in addition, the melted coolant may be kept in a bath where it is heated while cooling the workman and is conveyed therefrom to the evaporation position.

The cooling operation is preferably conducted at the lower portion of the body of the workman so that in addition to the cooling by the coolant, the workman can benefit further from the natural cooling of his body by sweating. Thus the coolant may conveniently be carried on a belt, trousers or the like.

According to another aspect of the invention, there is provided apparatus for cooling a workman working under thermally stressful conditions comprising a pocket adapted to contain solid meltable coolant, which pocket consists mainly of material which is impervious to the coolant when liquid, characterised by passage means from the pocket through which liquid coolant can pass to an evaporation position.

The apparatus may comprise a poncho or similar article of clothing or apparel or may be a belt or the like.

The passage means may comprise a tubular member leading from the interior of the pocket to the exterior. Alternatively, the passage means may be formed by a portion of the pocket material which is pervious to the movement therethrough of the liquid coolant and may be for example an open celled foam such as open celled polyurethane. The passage means is preferably of substantial length so that in passing from the interior of the pocket it is heated to a temperature which will not be excessively cold for the workman when it comes into contact with his skin.

If, however, the passage means is not sufficiently long for this purpose, the workman should be provided with suitable protective apparel at the evaporation position.

The passage means may be located at the deepest point in the pocket or it may be located somewhat thereabove so that a bath of liquid coolant will be formed within the pocket from which the liquid coolant will drain through the passage means to the evaporation position.

Embodiments of the invention will now be described by way of example with reference to the accompanying drawings.

In the drawings:

FIG. 1 is a diagrammatic sketch of a workman wearing a cooling apparatus of the invention.

FIG. 2 is a detail section through the pocket forming part of the apparatus of FIG. 1 with FIG. 2*a* showing an enlargment of the pocket wall, and FIG. 3 is a detail section through a pocket of another apparatus of the invention.

Referring now to FIG. 1 there is shown a workman 10 who is to work under thermally stressful conditions as for example in a very deep mine.

The workman 10 is wearing short trousers or pants 12 and a vest 14. He also wears a cooling apparatus 16 of the invention at his front. This apparatus 16 is carried on a belt 18 on which is also carried at the workman's back batteries 20 for the mine lamp (not shown) which the workman will also carry in the usual way.

The apparatus 16 comprises a large pocket 22 having a closable flap 24 that is held closed by "Velcro" strips or similar means. The pocket comprises two layers of plastic material 26 which is impervious to the passage therethrough of water. Between the two layers of plastic material 26 is a layer of insulation material 28 which may comprise any suitable material such a kapok, expanded plastics material—such as expanded polystyrene or expanded polyurethane. The insulation of the pocket 22 is preferably so chosen so that heat transfer between the side 30 of the pocket (hereinafter called "the inside") which is nearer the workman's skin is greater than the heat transfer on the other sides of the pocket. This can be effected by using a greater thickness of insulation material 28 or by suitable choice of different insulation materials as will be apparent to those skilled in this art.

Formed in the inside layer 30 of the pocket are a number of plastic tubes 32 and 34 which extend from the inside layer of material of the inside of the pocket to the outside layer 26. The tubes 32 pass from the lowermost position in the space 36 within the pocket while the tubes 34 pass from a position above such lowermost positions. These tubes 32 and 34 may extend directly from the one layer to the other (as shown in full lines in the drawings). However, they may follow tortuous paths (as shown in chain lines). The diameter of the tubes 32 and 34 is selected so that water can pass therealong from the interior of the pocket to the outside layer. The length of these tubes is such that water passing therealong will be heated to a reasonable temperature (say about 10° C.), before being discharged on to the body of the workman.

If desired, the tubes 34 may be ommitted so that any water which is received in the pocket when the ice melts will immediately run on to the body of the workman. In another arrangement, the tubes 32 which extend from the lowermost portion of the pocket may be ommitted so that a bath of water will be formed in the pocket as the ice melts. Only after a certain amount of water has been formed will the water escape from the pocket on to the body of the workman.

In the modified arrangement of the pocket as shown in FIG. 3, the pocket 40 again comprises two layers of impervious plastics material between which a layer of insulating material is received. In this arrangement, a "window" 42 of material which is pervious to the flow therethrough of water is let into the inside of the pocket. This window 42 conveniently is rectangular, although it can be any other shape as desired and comprises an open celled foam such as open celled polyurethane. The location of this window can be as shown in full lines at the lowermost position of the pocket or, as shown in chain lines, may be slightly above this position so that a bath may be formed in the pocket 40 as described above.

The path which the water passing through the "window" 42 must travel is a tortuous path and the water will be heated while travelling therealong, so that it will be discharged at a suitable temperature.

It will be seen that with both the apparatuses described above, the solid coolant, i.e. the block of ice, will melt due to transfer of heat from the workman. The melted coolant, i.e. the water, will now drip on to the clothes of the workman and this water will in turn cool the workman. Still further cooling takes place through two phase transformation, i.e. from solid to liquid and from liquid to gaseous as well as while the water is being heated from 0° C. to approximately 32° C.

It will also be seen that the workman's chest will not be encumbered by the pocket so that the workman can sweat and cool in a natural manner.

It will be understood that the workman need not have any underclothing on to which the water will drip.

Where thick underclothes are worn, the passage from the pocket may be very short, but preferably this passage will always be of significant length so that the water is suitably heated before reaching the workman.

The ice is preferably sub-cooled ice so that there will be additional heat transfer before it begins to melt. The ice may be solid or in "snow" form.

The insulation on the inside of the pocket is preferably such that the workman's skin temperature will be comfortable under the pocket i.e. of the order of 20° C. to 30° C.

The pocket may also be formed on a poncho or similar light article of apparel which will not be an encumbrance to the workman and will not prevent natural sweating of the body.

The battery will form a balance for the pocket on the belt.

The invention is not limited to the precise constructional details hereinbefore described with reference to and as illustrated in the drawings.

I claim:

1. Cooling apparatus for workmen working in thermally stressful conditions comprising:

(a) a pocket containg ice and having a front portion, a rear portion which is adjacent to the body of the wearer, side portions and upper and lower portions, each of said portions having an inner face within the pocket and outer faces outside the pocket, (b) insulating material forming a major part of at least the rear portion of the pocket, (c) water impervious material lining the inner faces of the said front, rear, side and lower portions and protecting the insulating material from contact with the content of the pocket, and (d) water conduit means guiding water through the pocket on to the body of the wearer.

2. Apparatus as claimed in claim 1 further comprising insulating material forming parts of the front and side portions of the pocket, which insulating material is protected from contact with the content of the pocket by the said water impervious material.

3. Apparatus as claimed in claim 2 wherein the insulating material forming part of the rear portion of the pocket provides greater heat transfer therethrough than the insulating material forming parts of the other portions.

4. Apparatus as claimed in claim 2 further comprising insulating material forming parts of the said upper and lower portions of the pocket.

5. Apparatus as claimed in claim 1 wherein the said water conduit means comprises tube means passing through the rear portion of the pocket.

6. Apparatus as claimed in claim 5 wherein the tube means follow tortuous paths.

7. Apparatus as claimed in claim 1 wherein the said water conduit means comprises tube means passing through the lower portion of the pocket.

8. Apparatus as claimed in claim 1 wherein the said water conduit means comprises a window of water pervious material forming a part of the rear portion of the pocket.

9. Apparatus as claimed in claim 8 wherein the water pervious means comprises an open celled foam.

10. Apparatus as claimed in claim 1 wherein the said water conduit means is located above the lower portion of the pocket so that a pool of water is contained within the pocket.

* * * * *